US009244439B1

(12) United States Patent
Allison et al.

(10) Patent No.: US 9,244,439 B1
(45) Date of Patent: Jan. 26, 2016

(54) COLOR CHANGING WRIST WATCH DEVICE AND ASSOCIATED METHOD

(76) Inventors: Charles Allison, Greensboro, NC (US); Willie Noble, III, Greensboro, NC (US)

( * ) Notice: Subject to any disclaimer, the term of this patent is extended or adjusted under 35 U.S.C. 154(b) by 0 days.

(21) Appl. No.: 12/759,190

(22) Filed: Apr. 13, 2010

Related U.S. Application Data

(60) Provisional application No. 61/169,105, filed on Apr. 14, 2009.

(51) Int. Cl.
*G04C 17/00* (2006.01)

(52) U.S. Cl.
CPC ..... *G04C 17/00* (2013.01)

(58) Field of Classification Search
USPC ..... 368/232–237, 228, 239
See application file for complete search history.

(56) References Cited

U.S. PATENT DOCUMENTS

| | | | | | |
|---|---|---|---|---|---|
| 3,782,104 | A * | 1/1974 | Kirsch | 368/82 |
| 3,803,831 | A * | 4/1974 | Horzick | 368/233 |
| 3,944,331 | A | 3/1976 | Janning | 350/160 |
| 4,541,727 | A * | 9/1985 | Rosenthal | 368/232 |
| 4,653,930 | A * | 3/1987 | Schmid | 368/77 |
| 4,660,992 | A * | 4/1987 | Paul et al. | 368/223 |
| 4,707,141 | A | 11/1987 | Havel | 368/11 |
| 4,775,964 | A * | 10/1988 | Alessio et al. | 368/67 |
| 4,885,731 | A * | 12/1989 | Massaro | 368/228 |
| 5,018,118 | A * | 5/1991 | Ross | 368/228 |
| 5,088,440 | A * | 2/1992 | Keaney | 116/298 |
| 5,224,078 | A * | 6/1993 | Mallin | 368/223 |
| 5,380,206 | A * | 1/1995 | Asprey | 434/257 |
| 5,422,864 | A * | 6/1995 | Lorello | 368/223 |
| 5,484,205 | A | 1/1996 | Grupp et al. | 374/142 |
| 5,586,089 | A * | 12/1996 | McGarvey | 368/223 |
| 5,638,341 | A * | 6/1997 | Amano | 368/223 |
| 5,646,913 | A * | 7/1997 | Quesenberry | 368/223 |
| 5,740,130 | A * | 4/1998 | Grupp et al. | 368/82 |
| 5,787,055 | A * | 7/1998 | Alpert | 368/223 |
| 5,793,710 | A * | 8/1998 | Jacobi, Jr. | 368/223 |
| 6,118,735 | A * | 9/2000 | Li | 368/228 |
| 6,579,006 | B1 | 6/2003 | Pariseau | 374/162 |
| 6,633,510 | B1 | 10/2003 | Hall | 368/24 |
| 6,639,875 | B2 | 10/2003 | Hall | 368/84 |
| 6,982,931 | B2 * | 1/2006 | Brewer et al. | 368/80 |
| 7,035,171 | B2 * | 4/2006 | Hurni et al. | 368/232 |
| 7,180,830 | B1 * | 2/2007 | Cotsen | 368/80 |
| 7,362,662 | B2 * | 4/2008 | Lang | 368/232 |
| D585,310 | S | 1/2009 | Allison | D10/39 |
| 2002/0054541 | A1 | 5/2002 | Hall | 368/84 |
| 2003/0165085 | A1 | 9/2003 | Brewer et al. | 368/82 |

* cited by examiner

*Primary Examiner* — Sean Kayes

(57) ABSTRACT

A wrist watch having an area of user selectable color preferably includes a watch body, watch face, heated surface, power source, and control. The watch body may be circular, square or rectangular in shape. The watch face is preferably covered by a watch crystal and the face color may be changed via thermochromatics or a color plate. A heated surface activates a color change in the thermochromatic watch face and a power source supplies a voltage to power the heating surface. A control allows manual control of the color change and may be located anywhere on the watch body.

10 Claims, 7 Drawing Sheets

COLOR CHANGING WRIST WATCH DEVICE AND ASSOCIATED METHOD

This application claims the benefit of provisional application Ser. No. 61/169,105, filed on Apr. 14, 2009.

BACKGROUND OF THE INVENTION (1) Field of the Invention

The present invention relates generally to watches and, more particularly, to a wrist watch having an area of user selectable color for providing users with a versatile fashion accessory capable of adjustment to visually match a user's apparel.

(2) Description of the Related Art

Wrist watches first became fashionable following World War I. Since then, many people have become accustomed to wearing wrist watches every day. Most watches are either gold or silver in color and feature a watch face that is either a black or white color. Recently, many watchmakers have begun marketing their product to a younger generation by replacing dull watch faces with faces in bright, vibrant colors such as yellow, orange or pink. Unfortunately, these different colors are attractive but not very practical, as a person is not likely to invest in a watch that can only be worn with certain outfits.

Thus, there remains a need for a new and improved device to overcome the above-noted shortcomings. The present invention satisfies such a need by providing a wrist watch having an area of user selectable color that is convenient and easy to use, lightweight yet durable in design, versatile in its applications, and designed for providing a user with a versatile fashion accessory capable of adjustment to visually match a user's clothing.

SUMMARY OF THE INVENTION

The present invention fulfills one or more of these needs in the art by providing in a typical embodiment, a wrist watch having an area of user selectable color. The watch body includes a timekeeping mechanism, a variable color thermochromatic watch face, and a heated surface for generating a desired temperature. The temperature affects the variable color of the thermochromatic watch face so that adjusting the temperature of the heated surface affects the color of the face. A power source supplies a voltage to power the heated surface and a control controls the power to achieve the desired temperature.

The variable color thermochromatic watch face typically includes liquid crystals which are one color at a given temperature and another color in the visible spectrum as the temperature is altered. Typically, the control is manually adjustable to control the color of the variable color thermochromic watch face.

The invention may also be considered to be a wrist watch including an area of user selectable color, with the watch including a watch body with a time keeping mechanism and a variable color watch face. The variable color watch face includes an interchangeable color plate which may be removably placed on the watch face. The color plate may be removable through a slot on the side of the watch body. A control piece secures and releases the interchangeable color plate from the variable color watch face.

These and other aspects of the present invention will become apparent to those skilled in the art after a reading of the following description of the preferred embodiment when considered with the drawings.

DESCRIPTION OF THE PREFERRED EMBODIMENTS

Figure 1:
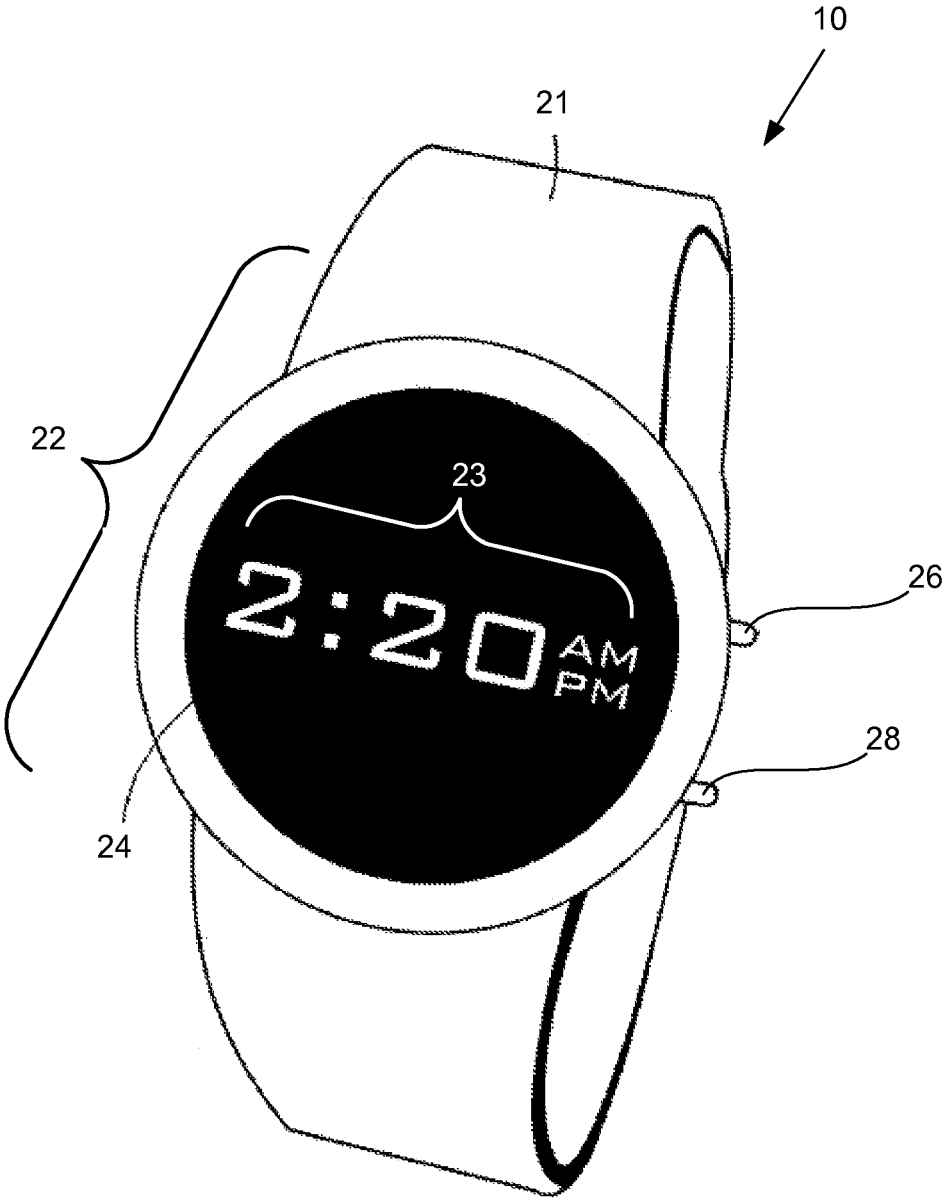
FIG. 1 is a frontal view of a wrist watch having an area of user selectable color constructed according to an embodiment of the invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a wrist watch having an area of user selectable color, generally designated 10, is shown constructed according to the present invention. Wrist watch 10 includes a watch body 22, a time keeping mechanism 23, a thermochromatic watch face 24, a heated surface 30, a power source 32 and a control 28. The power source and control form an electrical circuit that generate heat next to the surface 30 to raise its temperature. The temperature is lowered by reducing the current in the circuit using the control. The control may be a rheostat or electronic device. The wrist watch 10 may include a watch band 21 and conventional time control 26. The watch band 21 may be manufactured from steel, rubber, leather, cloth, or any other suitable material as desired by the user. Time control 26 may be pulled out and/or turned to change the time and date displayed on the watch and located anywhere on watch body 22. Optionally, time control 26 may be pushed to alter the time and date displayed on the watch. Such controls are conventional.

The watch body 22 includes timekeeping mechanism 23. Time keeping mechanism 23 may be an analog clock display or a digital type clock display together with the conventional electrical, electronic or mechanism to keep track of the time and alter the display accordingly. Watch body 22 includes a theromochromatic watch face 24. In one embodiment, thermochromatic watch face 24 includes leuco dyes which change colors when temperature activated. In an alternate embodiment, thermochromatic watch face 24 includes liquid crystals which change colors when temperature activated. The liquid crystals, preferably, may be in the form of a liquid crystal mixture, a microencapsulated thermochromatic liquid crystal slurry, a sprayable thermochromatic liquid crystal coating or a thermochromatic sheet. Combinations of these types of liquid crystal forms may optionally be combined for use in thermochromatic watch face 24.

Figure 3:
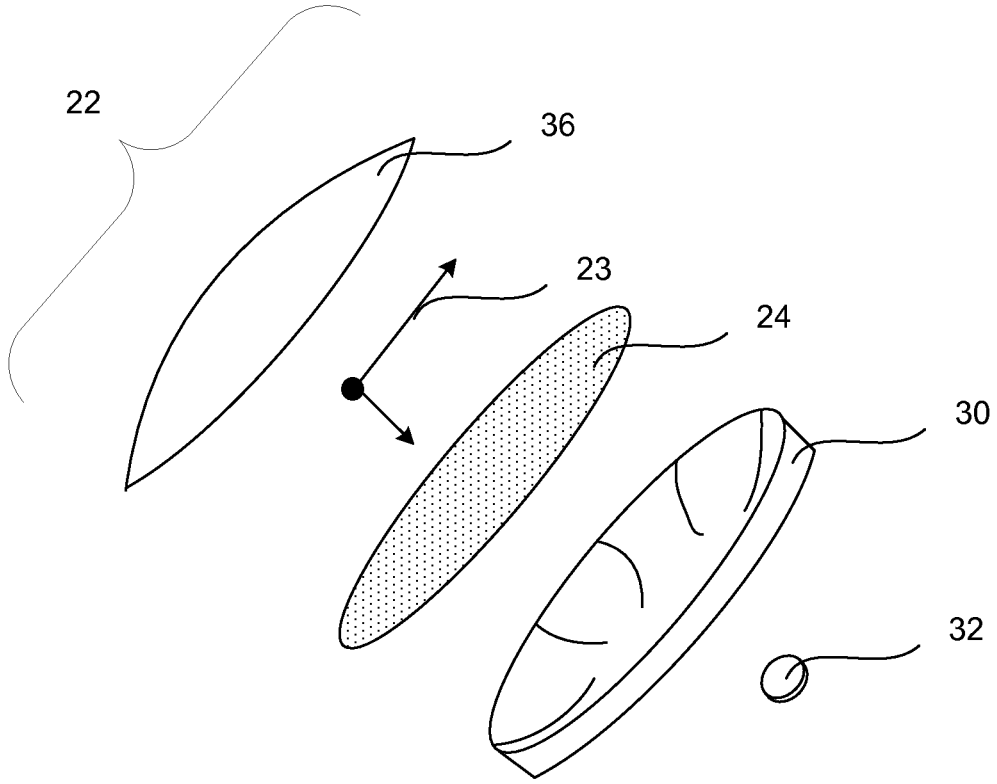
FIG. 3 is an exploded view of the watch body as shown in FIG. 1.

As best seen in FIG. 3, heated surface 30 rests next to thermochromic watch face 24. The temperature of heated surface 30 may be adjusted upwards or downwards and the differing temperatures activate varying colors in the thermochromatic watch face 24. Power source 32, such as a standard watch battery, outputs a voltage which supplies power to heat the surface 30. Control 28 may be turned, pulled or pushed in order to alter the temperature of heated surface 30, in turn, controlling the corresponding color of the thermochromatic substance in the thermochromatic watch face 24. Thermochromatic watch face 24 may be controlled by control 28 in order to maintain a desired color for a preselected period of time. Control 28 may be located anywhere on watch body 22. Timekeeping mechanism 23 and thermochromatic watch face 24 are preferably covered by watch crystal 36.

Figure 4:
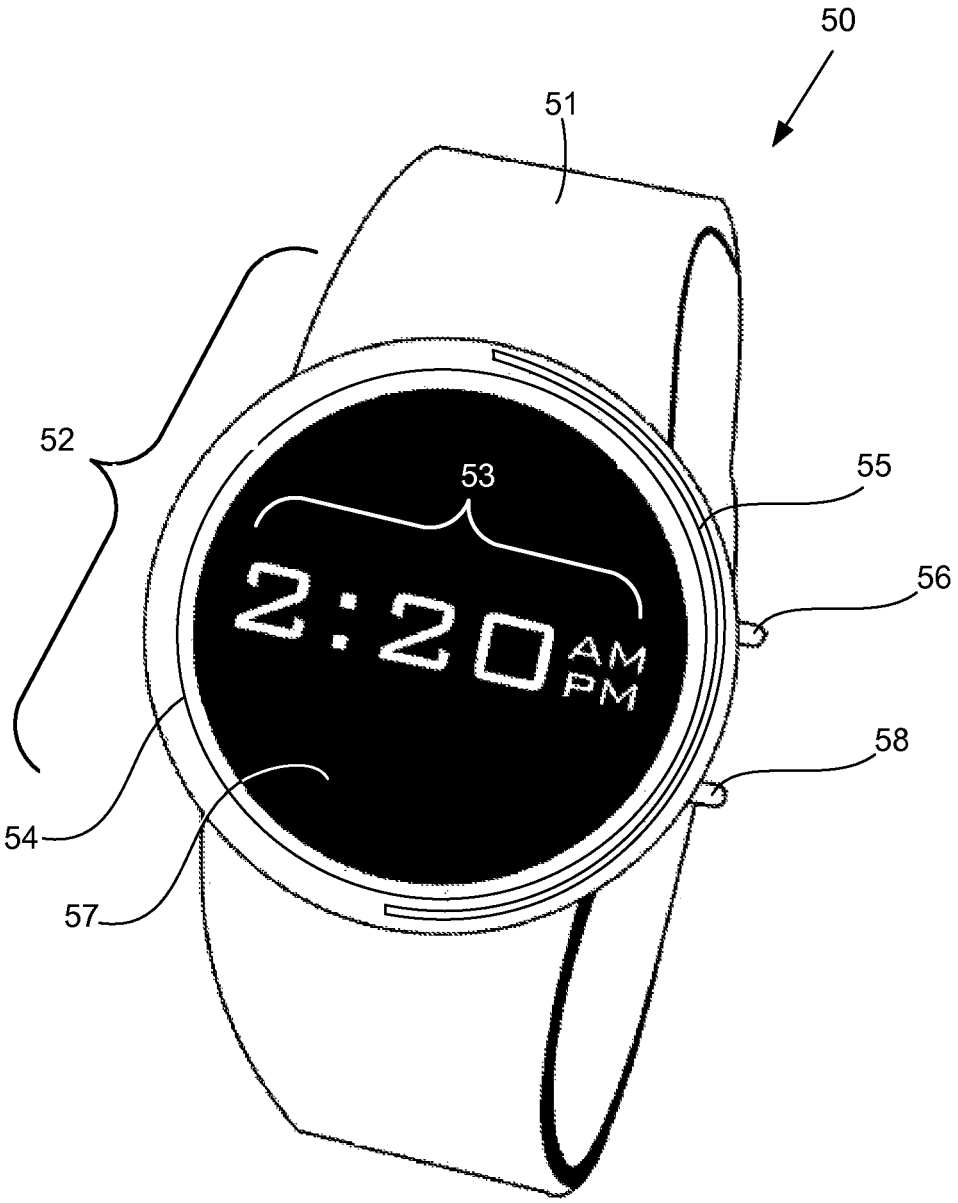
FIG. 4 is a frontal view of a wrist watch having an area of user selectable color and a slot constructed according to another embodiment of the present invention.

In another embodiment, as seen in FIG. 4, wrist watch having an area of user selectable color, general designated as 50, includes a watch body 52, watch face 54, color plate 57, slot 55 and control 58. The wrist watch 50 may further include a watch band 51 and time control 56 as with the embodiment of FIG. 1.

The watch body 52 includes timekeeping mechanism 53. Time keeping mechanism 53 may be an analog clock display or a digital type clock display and includes the same conventional time-keeping and display elements mentioned above for FIG. 1. The variable color watch face 54 incorporates a color plate 57. Color plate 57 is interchangeable and may contain a color, combination of colors, numbers, roman numerals, and a pattern, as well as a design. Time keeping mechanism 53 is visible through or on color plate 57. Color plate 57 may be tinted a color but yet transparent or may have an opening for allowing time keeping mechanism 53 to be seen. Color plate 57 is secured or released by biasing control 58 which may be located anywhere on watch body 52. Color plate 57 is removable by passing through slot 55 found on watch body 52. Optionally, watch 50 includes a plurality of interchangeable color plates 57 for supplying an array of color choices for covering watch face 54. Such plates are selectively interchangeable through slot 55 which provides access to watch face 54. Additionally, slot 55 may be covered by a door which opens to allow access to watch face 54 and closes once a color plate 57 is inserted.

Figure 6:
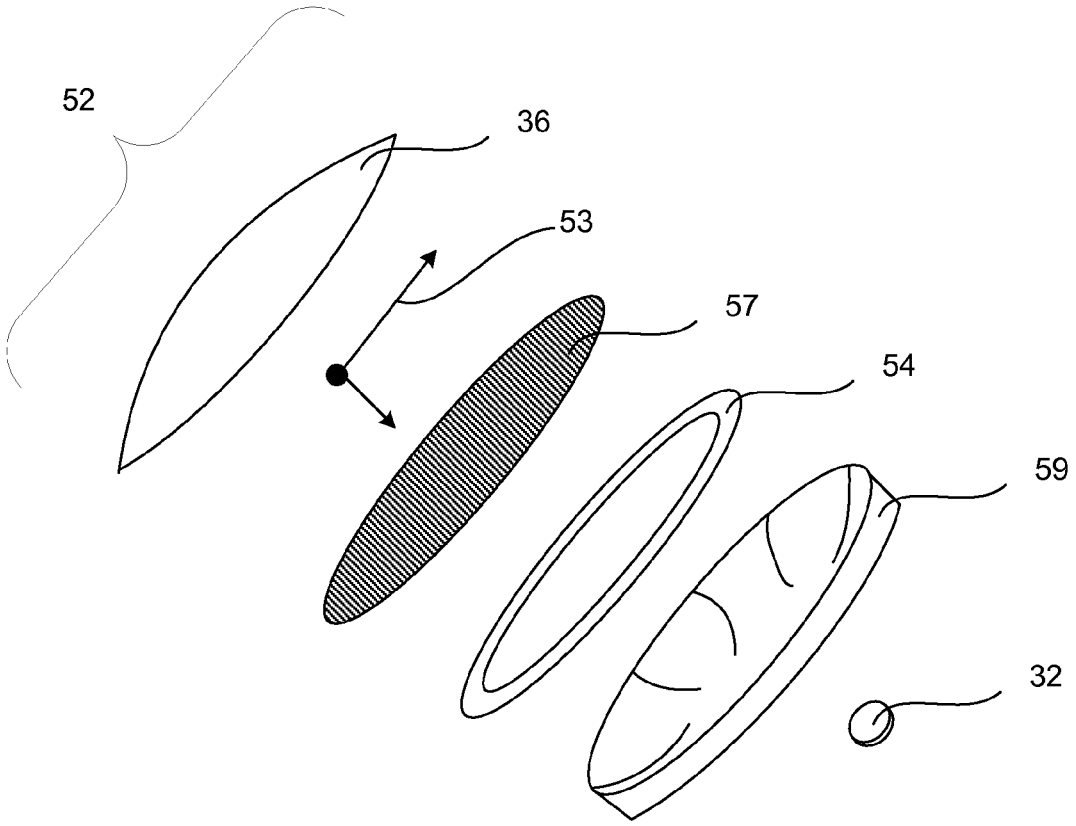
FIG. 6 is an exploded view of an embodiment of the watch body shown in FIG. 4.

Optionally, as seen in FIG. 6, a chamber 59 within the watch body provides a storage space for a plurality of color plates 57 when they are not being used on watch face 54. Preferably wrist watch 50 includes a watch crystal 36 covering timekeeping mechanism 53, watch face 54 and color plate 57.

Figure 7:
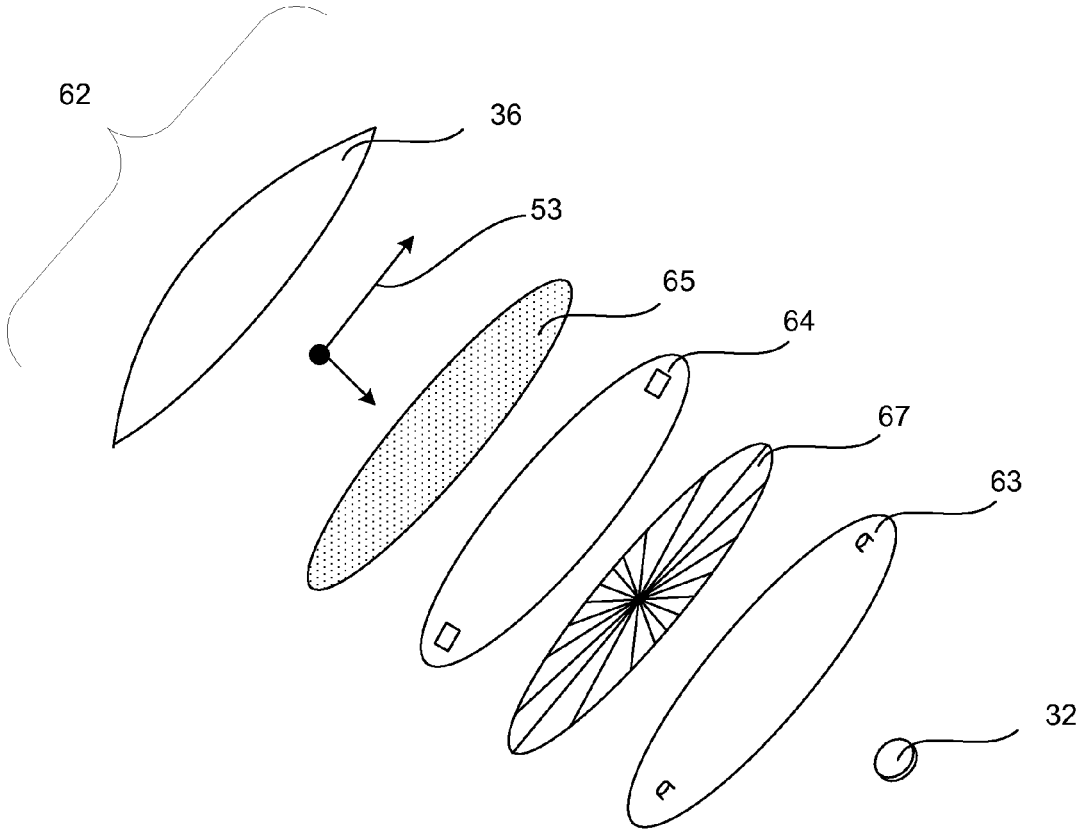
FIG. 7 is an exploded view of an embodiment of the watch body shown in FIG. 4.

In another embodiment, as seen in FIG. 7, watch body 62 includes time keeping mechanism 53, fiber optic plate 65, color plate 67, blocker 64 and LED source 63. A power source 32 powers the operation of LED source 63. Preferably, LED source 63 has a LED light located at opposing ends of the LED source 63, although other light placement on LED source 63 is within the scope of this invention.

Color plate 67 fits atop of LED source 63. Color plate 67 may be a single color or may contain a combination of colors. When color plate 67 contains more than one color, the colors may be interchangeable without color plate 67 being removable from watch body 62. The colors on color plate 67 may be in wedge shaped arrangement, as seen in FIG. 7, in addition to other arrangements, including but not limited to columnar, circular or blocked. In this embodiment, slot 55 may be located on the side of watch body 52 or may be a recess inside watch body 52 into which color plate 67 is secured.

As power source 32 powers LED source 63, the LED lights shine through the portion of color plate 67 that sits atop of the LED lights found on LED source 63. The illuminated color is projected up toward blocker 64. Blocker 64 deflects any colored light except the desired colored light, by allowing the desired colored light to pass through sheltered openings in blocker 64. When color plate 67 is rotated LED source 63 projects through a different color on color plate 67, thus allowing the color of watch face 62 to be changed, while blocker 64 deflects undesired colors. The light color allowed to pass through blocker 64 is passed to fiber optic plate 65. Blocker 64, LED source 63 and color plate 67 may be separate as depicted or may be incorporated into one or more pieces within watch body 62. Fiber optic plate 65 spreads the light passing through blocker 64 to the entire watch face via the plate of horizontally or vertically condensed optical fibers. As a result, a selectively colored watch face (not shown in FIG. 7) is visible through watch crystal 36.

Figure 2:
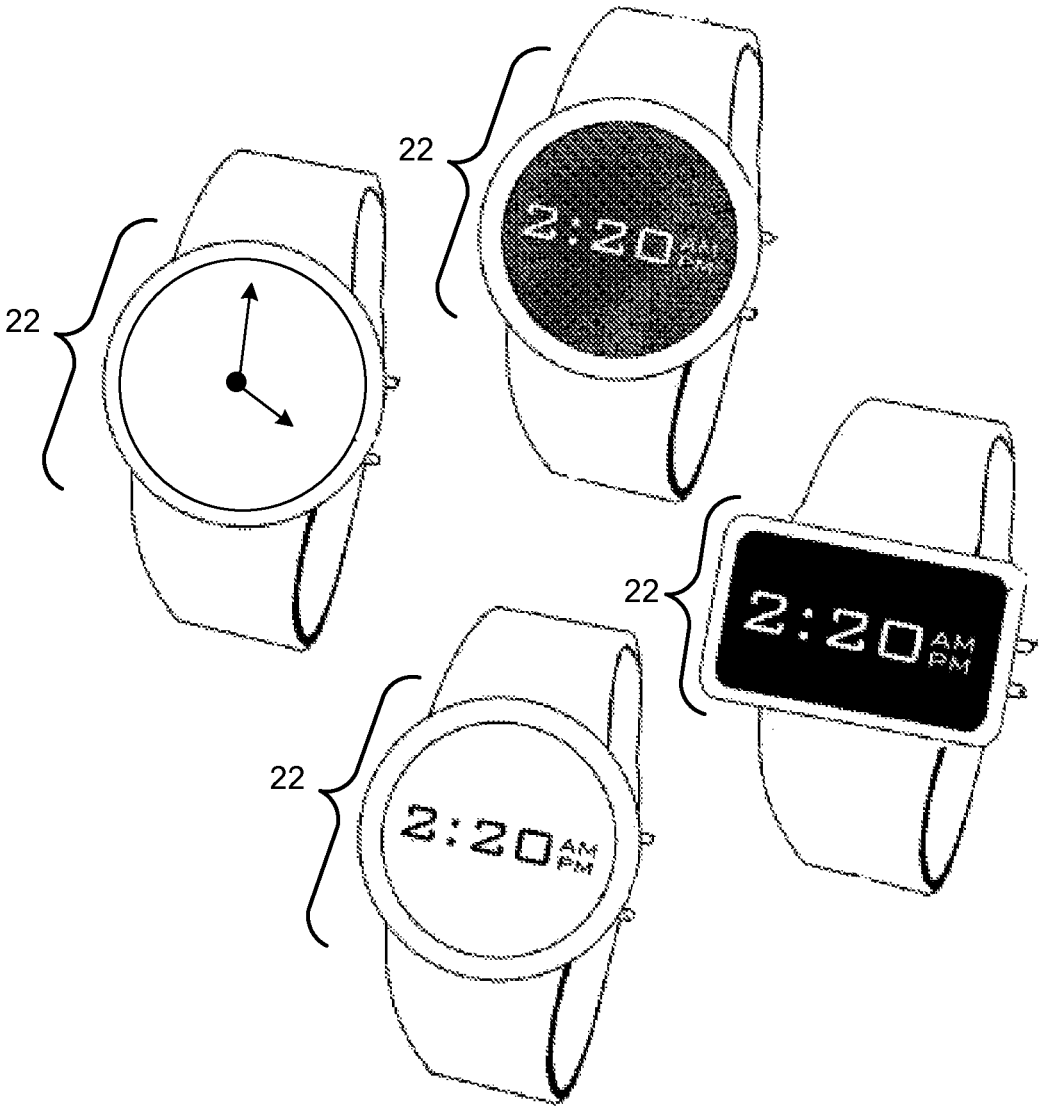
FIG. 2 shows frontal views of alternate embodiments of wrist watches having an area of user selectable color constructed according to the present invention.
Figure 5:
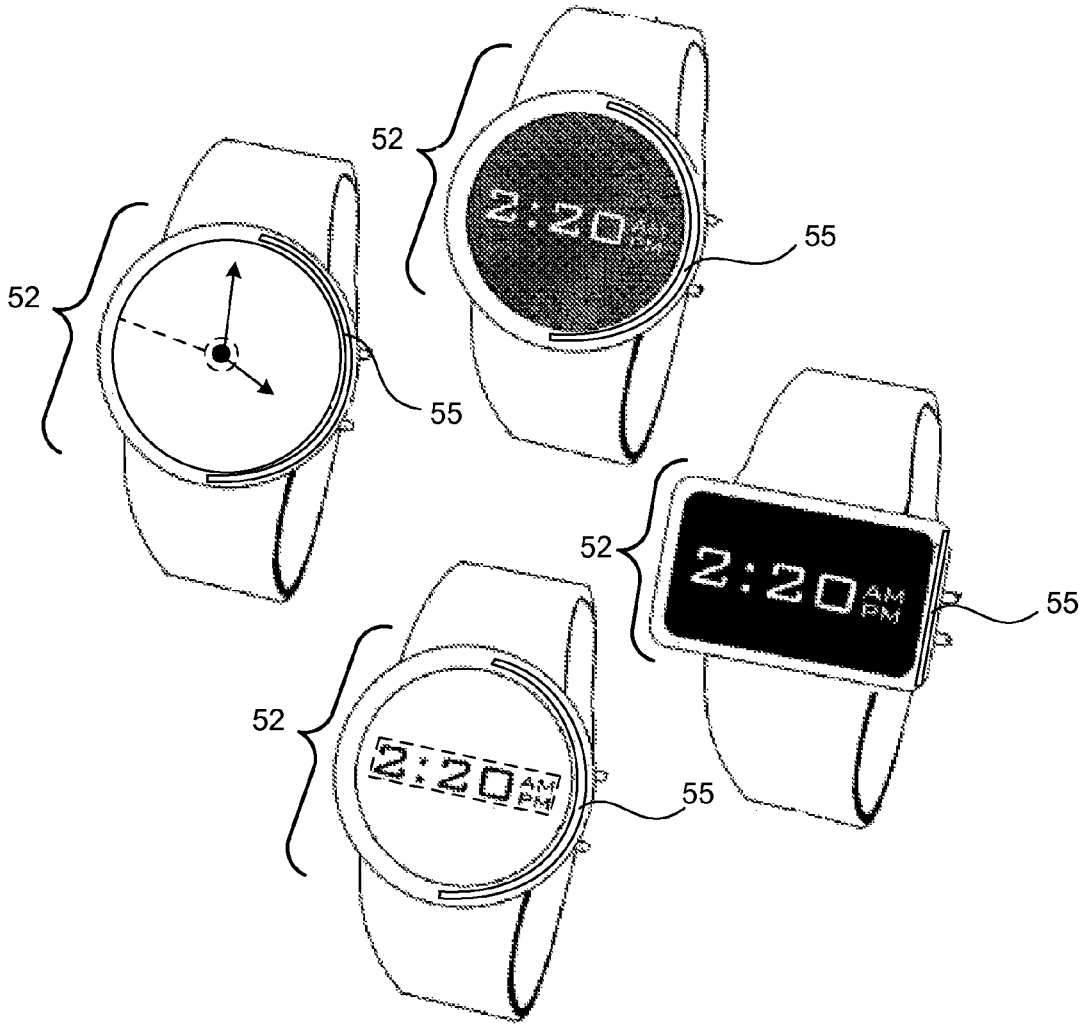
FIG. 5 shows a frontal view of alternate embodiments of the wrist watch having an area of user selectable color as seen in FIG. 4.

As seen in FIG. 2, FIG. 5 and FIG. 7, watch body 42, 52 and 62 respectively, may vary in appearance by color, style and shape. Watch body 42, 52 and 62 may be circular, rectangular, square, or other shape.

In operation, the wrist watch having an area of user selectable color 10 or 50 would be simple and straightforward to use. First, the user would purchase a watch 10, 50 with the color options most desirable to them. The user would then set the correct time and day. Next, the user would adjust the control 28 (FIGS. 1-3) to change out the color plate 57 or to select color on the color plate 67 (FIGS. 4-7) in order to change the color displayed on watch face 24, 54. For example, if the user is wearing a bright yellow shirt, the watch face 24, 54 color could be changed to yellow. Likewise, if the user is wearing a pink dress, the watch face 24, 54 color could be changed to pink to match the outfit. The colors of the watch 10 or 50 may additionally be set depending on whether the watch is for a male or female. The male colors may be blues, greens, yellows and oranges while the female colors may be pinks, purples and reds. Of course, there is possibility for overlap in the colors. The invention is also applicable to pocket watches and other clocks.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A watch having an area of user selectable color, comprising:

a watch body having a timekeeping mechanism;

a variable color thermochromatic watch dial that changes color with temperature changes and is contained within the watch body;

a surface adjacent the watch dial;

a power source having an output for supplying a current to heat the surface; and a control for controlling the current to the surface.

2. The watch having an area of user selectable color of claim 1, wherein the variable color thermochromatic watch dial includes leuco dyes.

3. The watch having an area of user selectable color of claim 1, wherein the variable color thermochromatic watch dial is selected from the group consisting of an unsealed thermochromatic liquid crystal mixture, a microencapsulated thermochromatic liquid crystal slurry, a sprayable thermochromatic liquid crystal coating, and a thermochromatic sheet.

4. The watch having an area of user selectable color of claim 1, wherein the thermochromatic watch display exhibits various colors as the temperature signal increases or decreases.

5. The watch having an area of user selectable color of claim 1, wherein the thermochromatic watch display maintains one color for an extended period of time, as controlled by the user.

6. The watch having an area of user selectable color of claim 1, wherein the control is a button or turn knob.

7. A watch having an area of user selectable color, comprising:

a watch body having a timekeeping mechanism;

a variable color thermochromatic liquid crystal watch dial that changes color with temperature changes contained within the watch body, wherein the variable color thermochromatic liquid crystal watch dial is one color at a given temperature and as the watch dial temperature is altered, becomes another color of the visible color spectrum;

a surface adjacent the thermocromatic watch dial in thermal contact with the watch dial;

a power source having an output for supplying a current to power the surface; and a control for manually controlling the current to selectively heat the surface, whereby the variable color thermochromatic liquid crystal watch face may be controlled to maintain a color for a given period of time.

8. The color changing watch of claim 7, wherein the variable color thermochromatic liquid crystal layer is selected from the group consisting of an unsealed thermochromatic liquid crystal mixture, a microencapsulated thermochromatic liquid crystal slurry, a sprayable thermochromatic liquid crystal coating, and a thermochromatic sheet.

9. The color changing watch of claim 7, further including a band.

10. The color changing watch of claim 7, further including a watch crystal covering the variable color watch dial.

* * * * *